United States Patent [19]

Andreassen et al.

[11] 4,198,282

[45] Apr. 15, 1980

[54] REPLACEABLE CATHODE UNIT SUITABLE AS A MODULE FOR BUILDING UP OF STABLE, NON-DEFORMABLE CATHODE SYSTEMS IN ELECTROLYZERS FOR THE PRODUCTION OF MAGNESIUM, AND AN ELECTROLYZER WITH CATHODE UNITS INCORPORATED THEREIN

[75] Inventors: Knut A. Andreassen; Henry K. Johnsen; Peder R. Solheim, all of Porsgrunn; Sigbjorn Kleveland, Oslo, all of Norway

[73] Assignee: Norsk Hydro A.S, Oslo, Norway

[21] Appl. No.: 908,235

[22] Filed: May 22, 1978

[30] Foreign Application Priority Data

Jun. 1, 1977 [NO] Norway ..... 771957

[51] Int. Cl.[2] ..... C25C 3/04; C25C 3/08; C25C 3/16; C25C 7/02

[52] U.S. Cl. ..... 204/243 R; 204/289; 204/70; 204/245

[58] Field of Search ..... 204/243 R, 243 M, 244, 204/245-247, 289, 70, 288

[56] References Cited

U.S. PATENT DOCUMENTS

| | | | |
|---|---|---|---|
| 2,528,905 | 11/1950 | Ollivier et al. | 204/243 R |
| 4,058,448 | 11/1977 | Dmitrievich et al. | 204/244 |

FOREIGN PATENT DOCUMENTS

| | | | |
|---|---|---|---|
| 510237 | 1/1955 | Italy | 204/243 R |
| 375318 | 9/1973 | U.S.S.R. | 204/243 R |
| 456851 | 3/1975 | U.S.S.R. | 204/243 R |

*Primary Examiner*—John H. Mack
*Assistant Examiner*—D. R. Valentine
*Attorney, Agent, or Firm*—Wenderoth, Lind & Ponack

[57] ABSTRACT

A replaceable cathode unit, suitable as a module for the building up of stable, non-deformable cathode systems in electrolyzers for the production of magnesium by melted salt electrolysis, is the form of a straight, longitudinal main cathode with active cathode side surfaces and two shorter transverse cathodes arranged approximately at right angles in relation to the main cathode. One transverse cathode is at the front end of the main cathode, and the other transverse cathode is at the back end of the main cathode.

11 Claims, 7 Drawing Figures

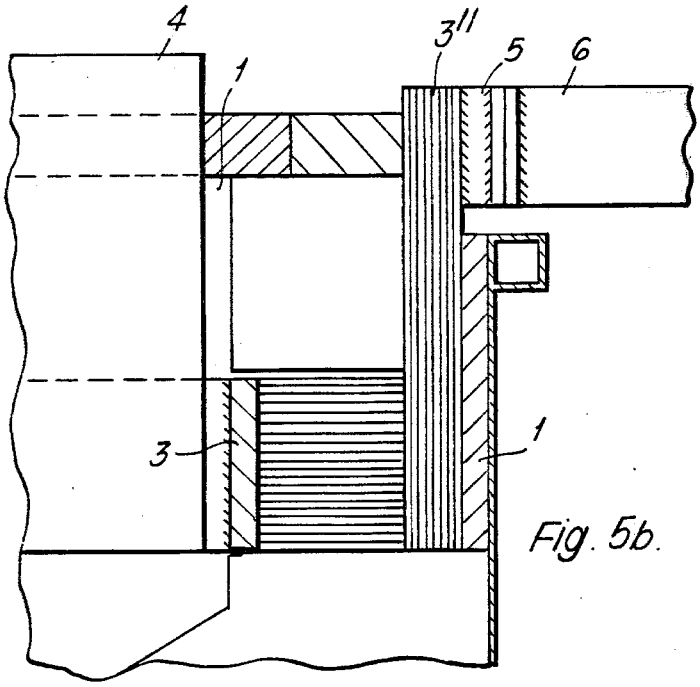
Fig. 5b.
Fig. 5a.
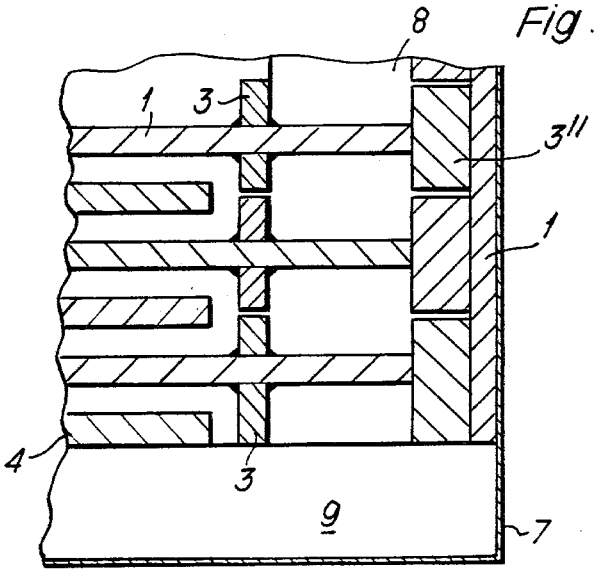

REPLACEABLE CATHODE UNIT SUITABLE AS A MODULE FOR BUILDING UP OF STABLE, NON-DEFORMABLE CATHODE SYSTEMS IN ELECTROLYZERS FOR THE PRODUCTION OF MAGNESIUM, AND AN ELECTROLYZER WITH CATHODE UNITS INCORPORATED THEREIN

BACKGROUND OF THE INVENTION

The invention relates to electrolyzers for the production of magnesium and more specifically to a new cathode unit suited for the building up of stable cathode constructions with a number of different configurations for use in such electrolyzers.

The well-known I.G. electrolyzers for the production of magnesium consist of a number of cells formed by one anode with vertical surfaces and two cathodes, each with an active electrode surface facing the anode. The chlorine gas and metal produced are maintained separate by means of special curtains, so-called diaphragms, which divide each cell into zones for collecting chlorine and magnesium, respectively. Therefore an electrolyzer having a plurality of cells has a number of gas- and metal-collecting zones.

To increase the effective or working surfaces of the electrode elements and also to increase the output of metal from each electrolyzer unit, it is known to arrange transverse cathode components running to the anode zone. Such transverse cathode elements are preferably arranged in parallel in relation to each other, at the same distance from each other and extending at right angles in relation to the main cathodes in such a way that that there will be formed closed cathode loops or frames enclosing the anodes. A closed cathode frame of such configuration is known from and described for the first time in U.S. Pat. No. 3,496,089.

However, the development has lately taken a direction towards larger and more efficient types of electrolyzers having double acting cathodes, wherein the gas from the cells is collected in a common zone and wherein the natural flow is utilized also to transport metal and electrolyte from each cell to a common separation and collection zone for metal. By the term "double acting cathodes" is thus meant cathodes where both side surfaces are electrolytically active and where each active surface faces a complementary anode surface. This means that anodes and cathodes are arranged alternatively one after the other in a row. Electrolyzers which work according to this principle comprise two main zones or areas, one electrolysis zone and one metal separation zone, which are separated by means of a partition wall. The partition wall has openings at the lower end for flow of electrolyte to the electrolysis zone and openings at the upper end, near the electrolyte surface, through which openings electrolyte and the magnesium metal formed will flow into the metal zone.

The known cathode frame principle with longitudinal and transverse cathode elements is also utilized in this more modern type of electrolyzer cell, such as, for example, described in U.S. Pat. No. 3,907,651, where the longitudinal hollow cathodes are connected by means of transverse steel plates welded to the cathodes, in such a way that there is formed a closed loop or frame enclosing each anode.

A drawback associated with the use of such closed cathode frames where two or more parts of the frame are in close contact with the electrolyzer wall, is that due to the high working temperatures and the limited possibilities for heat expansion there will be generated high strains in the material and deformation of the cathodes. Attempts have been made to solve this problem by reinforcing the cathode frames, but this has not, however, been a satisfactory solution.

Furthermore the frames are heavy and troublesome to handle in connection with the mounting or assembling of the electrolyzers and also in connection with the dissassembling of the same. Generally speaking, an extensive prefabrication of the components used for the assembly of electrolyzers is highly desirable. Concerning the use of cathode frames, such prefabrication has so far not been realized, as there have been no means of securing accurate mounting and the correct anode/-cathode spacing. During the manual assembly and bricklaying which today is performed, it will therefore be necessary to weld the cathode frames during the assembly of the electrolyzer cells, which additionally will complicate the utilization of cathode frames in magnesium electrolyzers.

SUMMARY OF THE INVENTION

It is the main object of the invention to provide a cathode unit which can be utilized as a module for the building up of a cathode system which inherently has all the well known advantages associated with the cathode frame principle, but where there is no danger of deformation of the cathodes or of the destruction of the walls in the electrolyzer cell. Furthermore the cathodes will be built up by cathode units which can be prefacricated and assembled and disassembled on the spot, thus providing a simple and expedient mounting and dismounting of the cathode.

The invention is based on the observation that as long as the double acting main cathodes are connected to and are transporting current, all the transverse cathode connections may be split up without applicable reduction of the electrolysis function of the transverse cathodes. Such simple remedy has led to the possibility of making replaceable cathode units, assembling these into cathode frames and surprisingly maintaining at the same time the advantages associated with the cathode frame construction with complete protection of the cell walls and the brickwork in the partition wall below the electrolyte surface. Furthermore the material tensions deforming the cathode and destroying the refractory brickwork are eliminated.

BRIEF DESCRIPTION OF THE DRAWINGS

The invention will below be described with reference to the accompanying drawings where:

FIG. 5*a* and FIG. 5*b* are respectively a horizontal section and a partial longitudinal section illustrating the utilization of the cathode unit for establishing current connection to a flexible cathode lead without penetrating the wall of a cell.

DETAILED DESCRIPTION OF THE INVENTION

Figure 1:
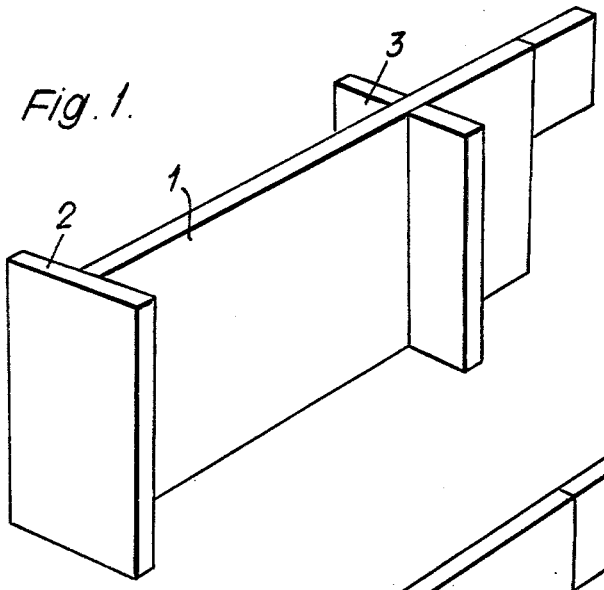
FIG. 1 and FIG. 1*a* are perspective view of a cathode unit with transverse cathode elements of the simplest possible configuration.

On FIG. 1 is shown a longitudinal mean cathode 1 of steel with vertical cathode surfaces. One end of the cathode is provided with a short, inner transverse cathode element 2 and at the other end a short outer transverse cathode element 3. Both transverse cathodes are welded or joined in any other convenient way to the main cathode and at right angles in relation thereto. The transverse cathodes are preferably formed with straight ends and are arranged symmetrically in relation to the main cathode so that they extend for equal lengths in opposite directions therefrom. The importance of the form of the ends and their arrangement will be outlined later.

Figure 1A:
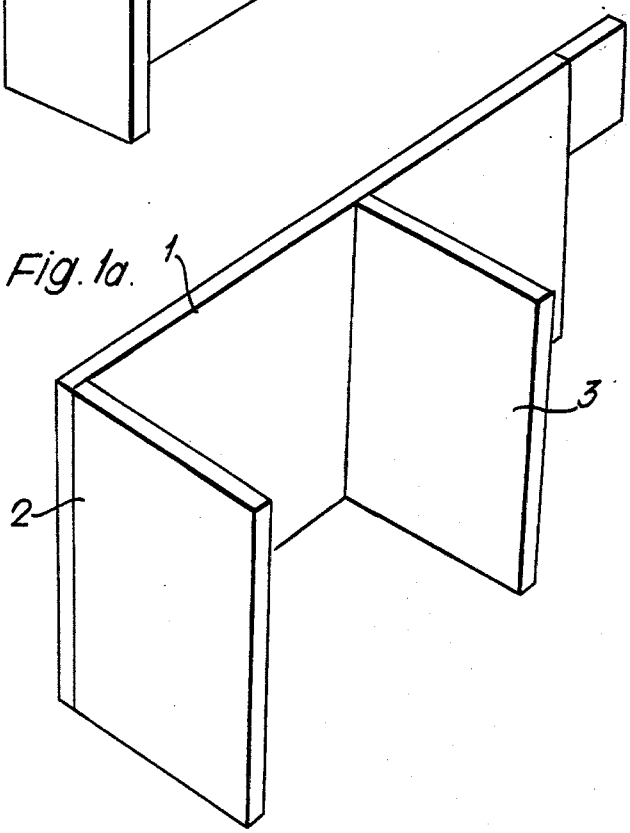

FIG. 1*a* shows this simple cathode unit in a somewhat modified configuration. The transverse cathodes 2 and 3 are here shown assymmetrically arranged in relation to the main cathode 1 and extending from only one side thereof. When these cathodes are mounted in a cathode frame, the slits are situated opposite the side surface of the main cathodes and the outer end of the transverse cathodes. The main advantages with this configuration is that the number of welds or welding connections between the main cathode and the transverse cathodes can be reduced by one half.

Figure 2:
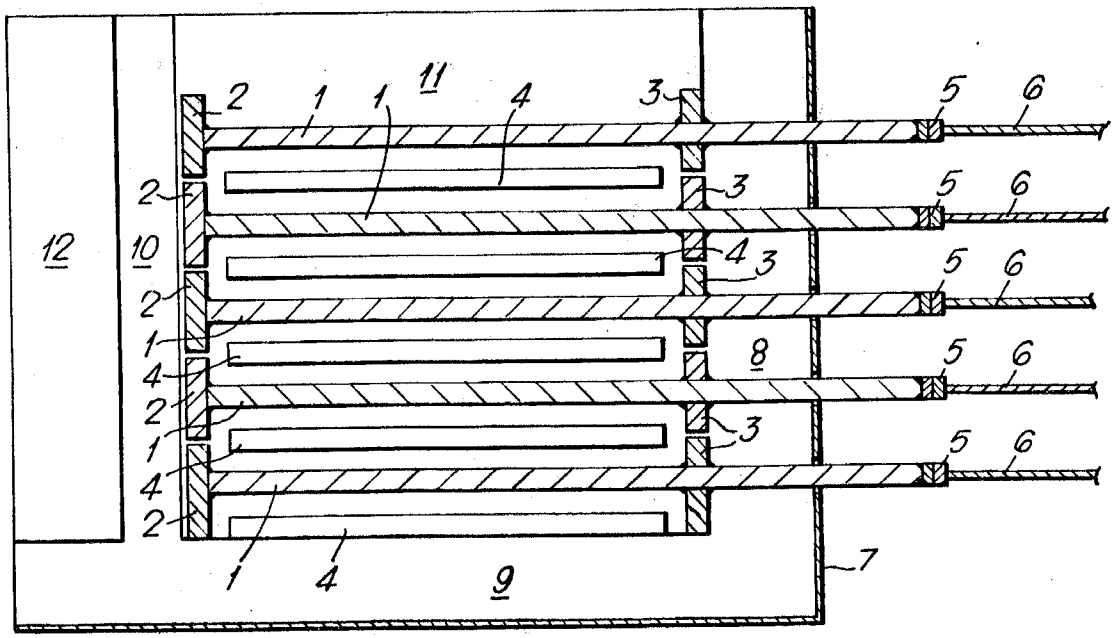
FIG. 2 is a horizontal section through part of a electrolyzer with cathode units alternatively mounted in relation to the anodes.

FIG. 2 shows the cathode unit according to FIG. 1 mounted in an electrolyzer. The electrolyzer, which in the drawing is shown in a horizontal section, is divided into two main zones or rooms, one electrolysis room 11 and one metal room 12 separated by means of a refractory partition wall 10. Further the electrolyzer comprises a refractory back wall 8 and two longitudinal refractory end walls 9. The longitudinal main cathodes 1 are lead through the refractory back wall 8 of the cell and are connected with flexible cathode leads 6 of aluminum over a steel/aluminium explosive connection 5. The refractory brickwork is further completely embedded in a steel mantel 7.

Figure 3:
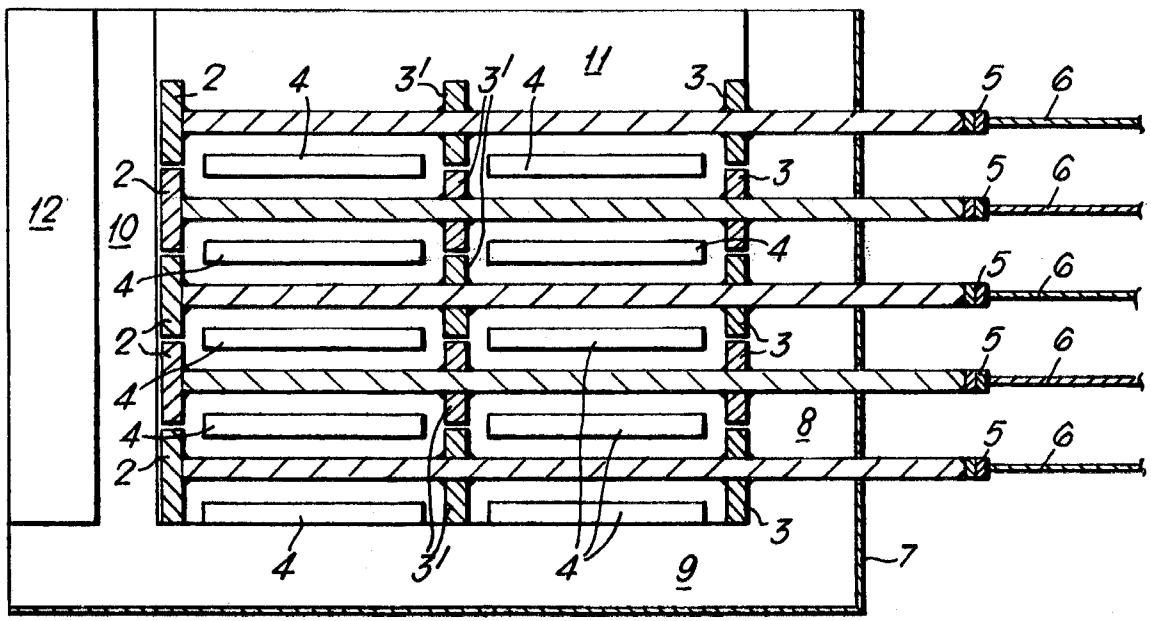
FIG. 3 is a section through an electrolyzer similar to FIG. 2, but with cathode units with intermediate transverse cathodes and split or intersected anodes.
Figure 4:
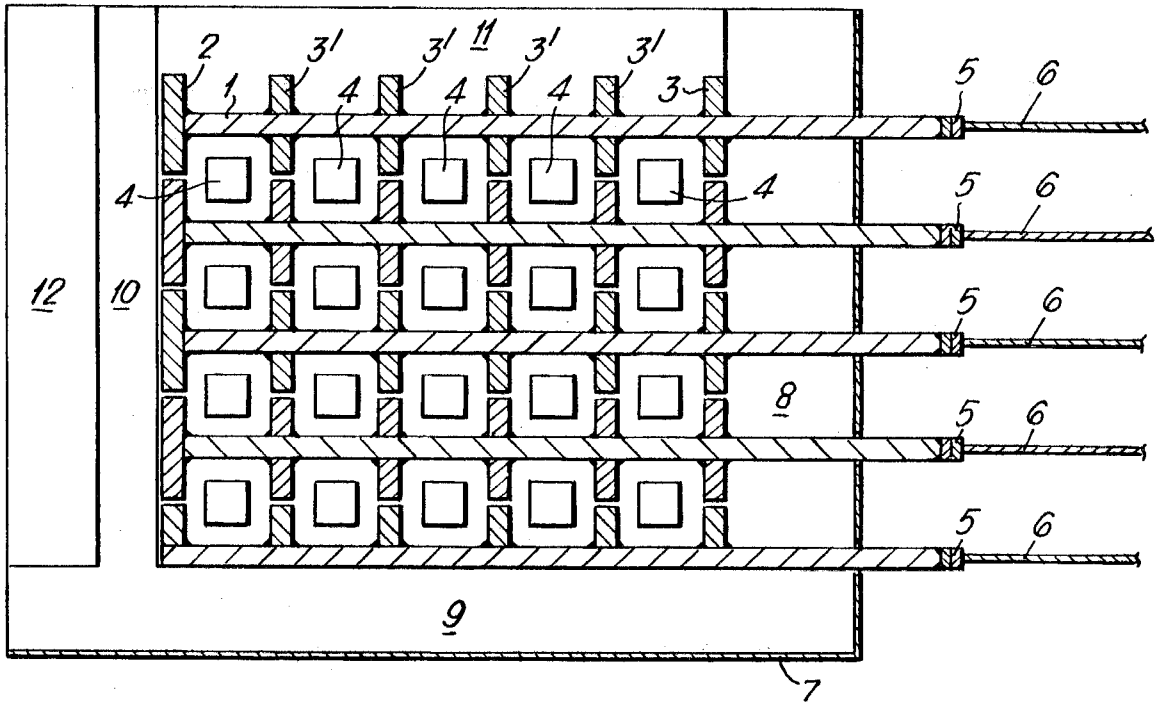
FIG. 4 is a sectional view similar to FIG. 3, with further splitting up of the anodes to form square cathode boxes.

FIG. 3 shows an electrolyzer where a modified configuration of the replaceable cathode units is incorporated, which cathodes units are provided with an intermediate transverse cathode 3' near the middle of the main cathode. The anodes 4 are split and intersected by the cathodes in the corresponding areas, where the transverse cathodes extend. This makes possible a drastic increase of the width of the electrolysis zone, due to the mutual supporting action of the intermediate, transverse cathodes. Utilizing several more transverse cathodes, this principle may be extended to establish a square cathode box configuration into which boxes a number of corresponding square anode rods are inserted. As shown on FIG. 4 a number of square anode rods 4 which are incorporated in the free space between the transversal cathodes may be employed. The transverse cathodes are then arranged to be spaced from each other by a distance approxiamtely equal to the distance between adjacent main cathodes. In this manner there is established a anode/cathode system with high efficiency and great stability.

The short transverse cathodes 3,3' are connected to the main cathode 1 in such way that they extend at right angles in relation thereto and they terminate with straight, cut end surfaces.

In the drawings the transversal cathodes are shown with the same sectional dimensions as the main cathode. The sectional dimensions may however be varied, but the dimensions have to be chosen in such a way that the transverse cathodes will stand up to some mechanical strain. In spite of the openings or slits between the cathodes it might still happen that an initial deformation of the cathodes may take place during the starting up of the cells to working temperature and also by varying working conditions. Such initial deformations will, however, be effectively stopped due to the specially constructed, rigid transverse cathodes with the straight, cut end surfaces, which are situated opposite corresponding end surfaces of adjacent cathodes. It is not easy to give precise specifications for dimensions of the elements, the distance between the openings, etc. Under practical working conditions, there have been utilized slits or openings of from 2.5 to 5 mm and plate dimensions or from 20 to 50 mm. These openings and material dimensions are thus preferred, but hardly critical.

In practice it will be impossible to make the main cathode and transverse cathode within such fine tolerances that a completely and accurate adjustment and contact between the end surfaces of the transverse cathodes are secured after expansion, when raising the cell temperature to working conditions. This is, however, no necessary condition due to the fact that one is not dependent upon any sort of current connection through the transverse cathodes themselves. Even slits or openings of several millimeters will not be detrimental to the electrolysis function.

A special configuration of the cathode unit makes it possible to establish current connection to the cathode without having to extend the cathode necks through the back wall of the electrolyzer. Such a construction is shown on FIGS. 5*a* and 5*b*. A final or terminating transversal cathode 3'' is here shown connected to the back part of the main cathode in the area adjacent the steel mantel 7 at the back of the cell. The transverse cathode 3'' extends up beyond the upper edge of the steel mantel 7 and is here connected with a flexible cathode lead 6 in any convenient way. The spaces between the back transverse cathodes 3'' and the conventional, active transverse cathode 3 in the electrolyzis room are filled up with a special refractory mass. When this refractory mass is heated it will harden and thus form a refractory wall between the active transversal cathodes 3 and the steel wall 7 in the back of the cell. In this way there is established a simple, but robust and strong current connection to the flexible cathode leads, without the necessity of passing the cathode necks through the back wall of the cell. This provides a simpler cell construction and mounting of the replaceable cathodes, while at the same time the mechanical strength of the back wall of the cell is not diminished.

According to an alternative construction, the steel mantel at the back of the cell may be completely omitted in the area where the last transverse cathodes 3'' are situated.

Hereby the transverse cathodes will act as a mantel in this area. In this way it will not be necessary to bring the transverse cathodes beyond the upper edge of the steel mantel and the cathode necks may be fastened to the flexible cathode leaks 6 in a conventional manner. Due to the fact that the transverse cathodes 3'' are conducting current, they have to be isolated from the rest of the steel mantel and they have to be connected to and supported by each other, for example utilizing straps or other convenient fastening and connecting means.

We claim:

1. A replaceable cathode unit suitable as a module for the assembly of stable, non-deformable cathode systems in electrolyzers for the production of magnesium by melted salt electrolysis, said cathode unit comprising:

a straight, longitudinally extending main cathode having active cathode side surfaces and front and back ends;

first and second shorter end transverse cathodes arranged at approximately right angles to said main cathode at said front end and said back end thereof, respectively, said transverse cathodes being arranged symmetrically with respect to said main cathode and extending equal distances from said side surfaces thereof;

at least one intermediate transverse cathode extending from said main cathode between said first and second end transverse cathodes; and said transverse cathodes being adapted to align with transverse cathodes of adjacent main cathodes to define plural anode spaces.

2. A replaceable cathode unit suitable as a module for the assembly of stable, non-deformable cathode systems in electrolyzers for the production of magnesium by melted salt electrolysis, said cathode unit comprising:

a straight, longitudinally extending main cathode having active cathode side surfaces and front and back ends;

first and second shorter end transverse cathodes arranged at approximately right angles to said main cathode at said front end and said back end thereof, respectively; and at least one intermediate transverse cathode extending from said main cathode between said first and second transverse cathodes, said transverse cathodes adapted to align with transverse cathodes of adjacent main cathodes to define plural anode spaces.

3. A cathode unit as claimed in claim 2, wherein each of said transverse cathodes is arranged symmetrically with respect to said main cathode and extends equal distances from said side surfaces thereof.

4. A cathode unit as claimed in claim 2, wherein said transverse cathodes are arranged asymmetrically with respect to said main cathode and extend from only one of said side surfaces thereof.

5. In an electrolyzer for the production of magnesium by melted salt electrolysis, said electrolyzer being of the type including an electrolysis zone defined by a partition wall, a back wall and two longitudinal walls, a metal zone separated from said electrolysis zone by said partition wall, said partition wall having therein upper openings for the flow of metal and electrolyte from said electrolysis zone to said metal zone, said partition wall further having therein lower openings for the return flow of electrolyte from said metal zone to said electrolysis zone, and cathodes and anodes alternately arranged in said electrolysis zone, the improvement wherein;

said cathodes comprise plural cathode units, each said cathode unit including a straight longitudinal main cathode extending through said electrolysis zone, said main cathode having active cathode side surfaces, a front end positioned adjacent said partition wall and a back end positioned adjacent said back wall, and first and second end transverse cathodes rigidly connected to said main cathode at said front and back ends thereof, respectively, said transverse cathodes having end surfaces; and said cathode units being positioned such that said transverse cathodes of adjacent said cathode units are aligned, with said end surfaces of said adjacent transverse cathodes being spaced by openings which are of uniform breadth and which break both mechanical as well as current connection between said adjacent transverse cathodes.

6. The improvement claimed in claim 5, wherein each said cathode unit further includes at least one intermediate transverse cathode extending from said main cathode between said first and second end transverse cathodes, with each pair of said adjacent cathode units forming plural box-shaped spaces, and each said space having positioned therein an anode.

7. The improvement claimed in claim 6, wherein the distance between adjacent said main cathodes equals the distance between adjacent said transverse cathodes of each said cathode unit, whereby said box-shaped spaces are substantially square, and wherein said anodes comprise square anode rods.

8. The improvement claimed in claim 5, wherein said electrolyzer further includes a steel mantel exterior of said back wall, each said cathode unit further comprises an outer transverse cathode extending outwardly of said electrolyzer without passing through said steel mantel, and further comprising flexible cathode leads connected to said outer transverse cathodes.

9. The improvement claimed in claim 5, wherein each said cathode unit further comprises an outer transverse cathode, said outer transverse cathodes forming an outer steel mantel of said electrolyzer.

10. The improvement claimed in claim 5, wherein said transverse cathodes are arranged at approximately right angles to the respective said main cathode and extend symmetrically by equal distances from said side surfaces thereof.

11. The improvement claimed in claim 5, wherein said transverse cathodes are arranged asymmetrically with respect to the respective said main cathode from only one of said side surfaces thereof.

* * * * *